US007690508B2

(12) United States Patent
Maruta

(10) Patent No.: US 7,690,508 B2
(45) Date of Patent: Apr. 6, 2010

(54) PLASMA TELEVISION PACKING STRUCTURE AND PANEL DISPLAY DEVICE PACKING STRUCTURE

(75) Inventor: Naoto Maruta, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 197 days.

(21) Appl. No.: 11/900,983

(22) Filed: Sep. 14, 2007

(65) Prior Publication Data

US 2008/0067096 A1 Mar. 20, 2008

(30) Foreign Application Priority Data

Sep. 19, 2006 (JP) ..... JP2006-252681

(51) Int. Cl.
*B65D 81/05* (2006.01)
*B65D 85/30* (2006.01)

(52) U.S. Cl. ..... 206/453; 206/521

(58) Field of Classification Search ..... 206/320, 206/576, 591, 592, 593, 594, 701
See application file for complete search history.

(56) References Cited

U.S. PATENT DOCUMENTS

| | | | | |
|---|---|---|---|---|
| 2,926,779 | A * | 3/1960 | Jepson | 206/765 |
| 5,111,937 | A * | 5/1992 | Schutz | 206/386 |
| 5,226,543 | A * | 7/1993 | Foos et al. | 206/592 |
| 5,779,055 | A * | 7/1998 | Lacy, III | 206/701 |
| 2003/0213725 | A1 * | 11/2003 | Koike | 206/588 |
| 2005/0050784 | A1 * | 3/2005 | Bang et al. | 40/607.01 |
| 2005/0155890 | A1 * | 7/2005 | Manuel | 206/523 |
| 2005/0252826 | A1 * | 11/2005 | Boeller et al. | 206/593 |
| 2005/0263427 | A1 * | 12/2005 | Schneider et al. | 206/523 |
| 2006/0113214 | A1 * | 6/2006 | Shimizu et al. | 206/576 |
| 2007/0056866 | A1 * | 3/2007 | Chih | 206/320 |
| 2007/0187283 | A1 * | 8/2007 | Otsuka et al. | 206/576 |

FOREIGN PATENT DOCUMENTS

| | | | |
|---|---|---|---|
| EP | 1787914 | A | 5/2007 |
| JP | 1988-040394 | U | 3/1988 |
| JP | 2002-302189 | | 10/2002 |
| JP | 2002-302189 | A | 10/2002 |

(Continued)

OTHER PUBLICATIONS

Japanese Notice of the reason for refusal, dated Jul. 23, 2008.

(Continued)

*Primary Examiner*—Jacob K Ackun, Jr.
*Assistant Examiner*—King M Chu
(74) *Attorney, Agent, or Firm*—Yokoi & Co., U.S.A., Inc.; Peter Ganiian

(57) ABSTRACT

The present invention discloses a packing structure for a panel display device comprising a box having a base portion space that is created in a lower cushioning member on a side of a back of a main body and receives the base portion of a stand with a long side of the base portion oriented horizontally; a stand disposed in the base portion space with a shaft portion extended along a back of the main body; and the box accommodating the lower cushioning member, the main body, an upper cushioning member, and the stand.

14 Claims, 10 Drawing Sheets

FOREIGN PATENT DOCUMENTS

| | | | |
|---|---|---|---|
| JP | 2004-131100 | | 4/2004 |
| JP | 2004-131100 | A | 4/2004 |
| JP | 3117473 | U | 11/2005 |
| JP | 3118275 | U | 12/2005 |
| JP | 3188275 | U | 12/2005 |
| JP | 2006-089069 | | 4/2006 |

OTHER PUBLICATIONS

The extended European search report, pursuant to Rule 62 EPC dated Oct. 13, 2008, searched on Oct. 2, 2008.

* cited by examiner

PRIOR ART

PRIOR ART

PLASMA TELEVISION PACKING STRUCTURE AND PANEL DISPLAY DEVICE PACKING STRUCTURE

CROSS-REFERENCES TO RELATED APPLICATIONS

The present application is related to the Japanese Patent Application No. 2006-252681, filed on Sep. 19, 2006, the entire disclosure of which is expressly incorporated by reference herein.

BACKGROUND OF THE INVENTION

1. Field of the Invention

The present invention relates to a plasma television packing structure and a panel display device packing structure.

2. Description of the Related Art

FIG. 9 and FIG. 10 show a conventional packing structure for a stands-inclusive plasma television 1. FIG. 9 is a perspective view showing a sequence ended with mounting of a main body 1*a* in a lower box. FIG. 10 is a perspective view showing a scene where an upper box is united with the lower box in which the main body is mounted.

In FIG. 9, a lower left cushioning member 2*a*, a left stand cushioning member 2*b*, a lower middle cushioning member 2*c*, a right stand cushioning member 2*d*, and lower right cushioning member 2*e* which are made of expanded polystyrene are mounted on the inner bottom of a lower box 3*a* placed on a platform with the opening of the lower box oriented above. The lower left cushioning member 2*a*, lower middle cushioning member 2*c*, and lower right cushioning member 2*e* have dents that are engaged with the bottom of the main body 1*a* of the plasma television 1. The lower left cushioning member 2*b*, lower middle cushioning member 2*c*, and lower right cushioning member 2*e* fill the role of creating a space of a predetermined distance between the main body 1*a* engaged with the dents and the lower box 3*a*, and buffering an impact to be applied to the periphery of the lower box 3*a* in the respective regions thereof with which the main body 1*a* comes into contact.

Moreover, the plasma television 1 includes a left stand 1*b* and a right stand 1*c* that substantially vertically bears the display surface of the main body 1*a*. The stands each have a base portion elongated in the direction from front to back of the main body 1*a* and a shaft portion extended vertically upward from the base portion. The shaft portions of the stands are inserted into respective shaft holes formed in the bottom of the main body 1*a* horizontally with a predetermined space between them, and then firmly screwed. Consequently, the stands are jutted downward from the bottom of the main body 1*a*, and elongated from front to back. The left stand cushioning member 2*b* and right stand cushioning member 2*d* are interposed between the respective bottoms of the respective base portions of the left stand 1*b* and right stand 1*c* and the lower box 3*a*. The left stand cushioning member 2*b* and right stand cushioning member 2*d* fill the role of creating a predetermined space between the lower box 3*a* and each of the stand base portions, and protecting the stand base portions or stands and the main body 1*a* coupled to the stands by buffering an impact to be applied to the periphery of the lower box 3*a*.

The main body 1*a* enclosed in an inner sack 4, the left stand 1*b*, and the right stand 1*c* are placed on the cushioning members 2*a* to 2*d* disposed as mentioned above. A reinforcement member 5 formed by folding a sheet of cardboard so that the reinforcement member will have a section shaped like a bracket is disposed to cover the back of the main body 1*a* as well as the right and left flanks thereof. The lower side of the reinforcement member 5 has portions jutted downward in the regions thereof which come into contact with the lower left cushioning member 2*a*, lower middle cushioning member 2*c*, and lower right cushioning member 2*d* respectively. The jut portions are fitted into fitting holes formed in the lower left cushioning member 2*a*, lower middle cushioning member 2*c*, and lower right cushioning member 2*e* respectively. Moreover, the upper side of the reinforcement member 5 has portions jutted upward in the regions thereof which come into contact with an upper left cushioning member 6*a*, an upper middle cushioning member 6*b*, and an upper right cushioning member 6*c* respectively. The jut portions are fitted into fitting holes formed in the upper left cushioning member 6*a*, upper middle cushioning member 6*b*, and upper right cushioning member 6*c* respectively. Consequently, even when an impact oriented vertically is applied to the upper box or lower box, the space between the lower left cushioning member 2*a*, lower middle cushioning member 2*c*, and lower right cushioning member 2*e* located under the main body 1*a* and the upper left cushioning member 6*a*, upper middle cushioning member 6*b*, and upper right cushioning member 6*c* located on the main body 1*a* is retained at a predetermined length in order to buffer an impact to be applied to the main body 1*a*.

The upper left cushioning member 6*a*, upper middle cushioning member 6*b*, and upper right cushioning member 6*c* are disposed on the top of the main body 1*a*. The upper box 3*b* is placed from above and united with the lower box 3*a*, whereby a package accommodating the entire plasma television 1 while covering it is completed. The upper left cushioning member 6*a*, upper middle cushioning member 6*b*, and upper right cushioning member 6*c* have dents that are engaged with the top of the main body 1*a*. The upper left cushioning member 6*a*, upper middle cushioning member 6*b*, and upper right butter 6*c* fill the role of creating a space of a predetermined distance between the main body 1*a* engaged with the dents and the upper box 3*b*, and protecting the main body 1*a* by buffering an impact to be applied to the periphery of the upper box 3*b* in the respective regions thereof with which the main body 1*a* comes into contact.

Known technologies for packing a display device such as a television will be described below. Specifically, a technology of packing a display device with a display surface thereof placed horizontally in a box, opening one of four lateral sides so as to stand the display device, and thus making it easy to take out the display device is described in Utility Model Registration No. 3117473. Moreover, Japanese Unexamined Patent Application Publication No. 2004-131100 says that stand bases and stand supports are disassembled from a display and the display is packed to be opposed to the stand bases. Moreover, Japanese Unexamined Patent Application Publication No. 2002-302189 says that cushioning members are disposed at right and left ends of a lower box of a container, in the center of the lower box, at right and left ends of an upper box thereof, and in the center of the upper box respectively, and have dents that are engaged with a module pack. Moreover, Japanese Unexamined Patent Application Publication No. 2006-89069 says that stands are put in a lower package and a display held in cushioning members is stored in a space above the stands.

However, as far as the foregoing conventional packing structure is concerned, since the stands 1*b* and 1*c* are packed as integral parts of the main body 1*a*, the packing structure is vertically elongated. This necessitates a package whose length in a direction from front to back is larger than the length of the base portions of the stands. Consequently, an increase in the number of packages to be loaded in a freight container is not expected.

Moreover, a structure for packing a display device with stands thereof detached therefrom has been proposed in the past. In this case, a user is obliged to perform the work of attaching the stands to the display device. At this time, the main body has to be laid or the stands have to be aligned with the display device that is placed on its back. The user finds the work cumbersome.

BRIEF SUMMARY OF THE INVENTION

The present invention discloses to provide a plasma television packing structure making it possible to increase the number of packages to be loaded in a freight container by decreasing the volume of the package of a panel display device, to simplify attachment of stands to the panel display device that is packed with the stands detached therefrom, and to increase the number of packages to be loaded in a freight container by decreasing the volume of the package while simplifying attachment of stands to a plasma television that is packed with the stands detached therefrom.

One aspect of the present invention provides a packing structure for a panel display device comprising a main body that includes a panel display unit, and a stand that has a base portion elongated form forth to back and a shaft portion extending vertically upward from the base portion, that holds the main body, and that is detachable from the main body, the packing structure comprising:

a box elongated horizontally with an upper side that can be left open;

a lower cushioning member disposed on an inner bottom of the box;

the lower cushioning member having a dent that is engaged with a bottom of the main body;

an upper cushioning member disposed inside a top of the box;

the upper cushioning member having a dent that is engaged with a top of the main body;

the box having a base portion space that is created in the lower cushioning member on a side of a back of the main body and receives the base portion of the stand with a long side of the base portion oriented horizontally;

the stand disposed in the base portion space with the shaft portion extended along the back of the main body; and the box accommodating the lower cushioning member, the main body, the upper cushioning member, and the stand.

Owing to the above structure, in the packing structure, the right and left stands are disposed behind the main body with the shaft portions thereof placed along the back of the main body and with the long sides of the base portions thereof oriented horizontally. Consequently, the base portions elongated from front to back are oriented horizontally, and the shaft portions are placed along the back of the main body. The volume of the box from front to back can be reduced. Moreover, since the stands are detached, the vertical volume is also reduced.

An optional aspect of the present invention provides the above structure wherein the upper cushioning member includes an upper right cushioning member to be disposed at the right end of the top of the main body, an upper left cushioning member to be disposed at the left end of the top of the main body, and an upper middle cushioning member to be disposed substantially in the horizontal center of the top of the main body. The upper right cushioning member and upper left cushioning member each have a dent that is engaged with the base portion of the right or left stand, and a jut formed outside a region thereof that comes into contact with the rear end of the base portion. Slits that are fitted to the juts may be formed at offset positions at the lower end of the box so that the slits will be spaced by a width equivalent to the width between the shaft portions attached to the main body. Since the upper cushioning members are disposed at three respective positions, that is, at the left end, in the center, and at the right end respectively, the number of cushioning members is decreased. Moreover, the separated cushioning members may be utilized in order to provide a stand attachment structure helping attach the stands to the main body. In this structure, the juts are fitted into the slits, the base portions of the right and left stands are engaged with the respective dents, and the shaft portions are inserted into insertion holes formed in the bottom of the main body in order to attach the stands to the main body.

An optional aspect of the present invention provides the above structure wherein the direction from front to back of the stands to be fitted into the dents may be squared with the direction from front to back of the main body stored in the box. In this case, when the main body is taken out of the lower box and moved in parallel, the main body is located above the stand attachment structure. The amount of work a user has to perform for attachment of the stands to the main body can be reduced.

An optional aspect of the present invention provides the above structure wherein the box may include a substantially parallelepiped lower box whose upper side is left open and which has the lower cushioning member placed on the inner bottom thereof, and an upper box to be united with the lower box from above. According to this structure, since the upper box and lower box are independent of each other, the panel display device can be easily taken out of the lower box.

An optional aspect of the present invention provides the above structure wherein the height of the lower box may be substantially identical to the height of the lower cushioning member. Namely, when the heights of the lower box and cushioning member are substantially squared with each other, if the main body is detached from the lower cushioning member, the main body can be moved sideways and taken out of the box. A load a user incurs at the time of unpacking can be reduced.

An optional aspect of the present invention provides the above structure wherein the lower cushioning member may include a lower right cushioning member to be disposed at the right end on the inner bottom of the box, a lower left cushioning member to be disposed at the left end on the inner bottom of the box, and a lower middle cushioning member to be disposed substantially in the horizontal center of the inner bottom of the box. The base portion space may include a space created between the lower left cushioning member and lower middle cushioning member, and a space created between the lower right cushioning member and lower middle cushioning member. Namely, since the lower cushioning members are located at three respective positions, that is, at the left end, in the center, and at the right end respectively, the number of cushioning members can be decreased. Moreover, the detached stands can be disposed among the cushioning members.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purpose of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

DETAILED DESCRIPTION OF THE INVENTION

Figure 1:
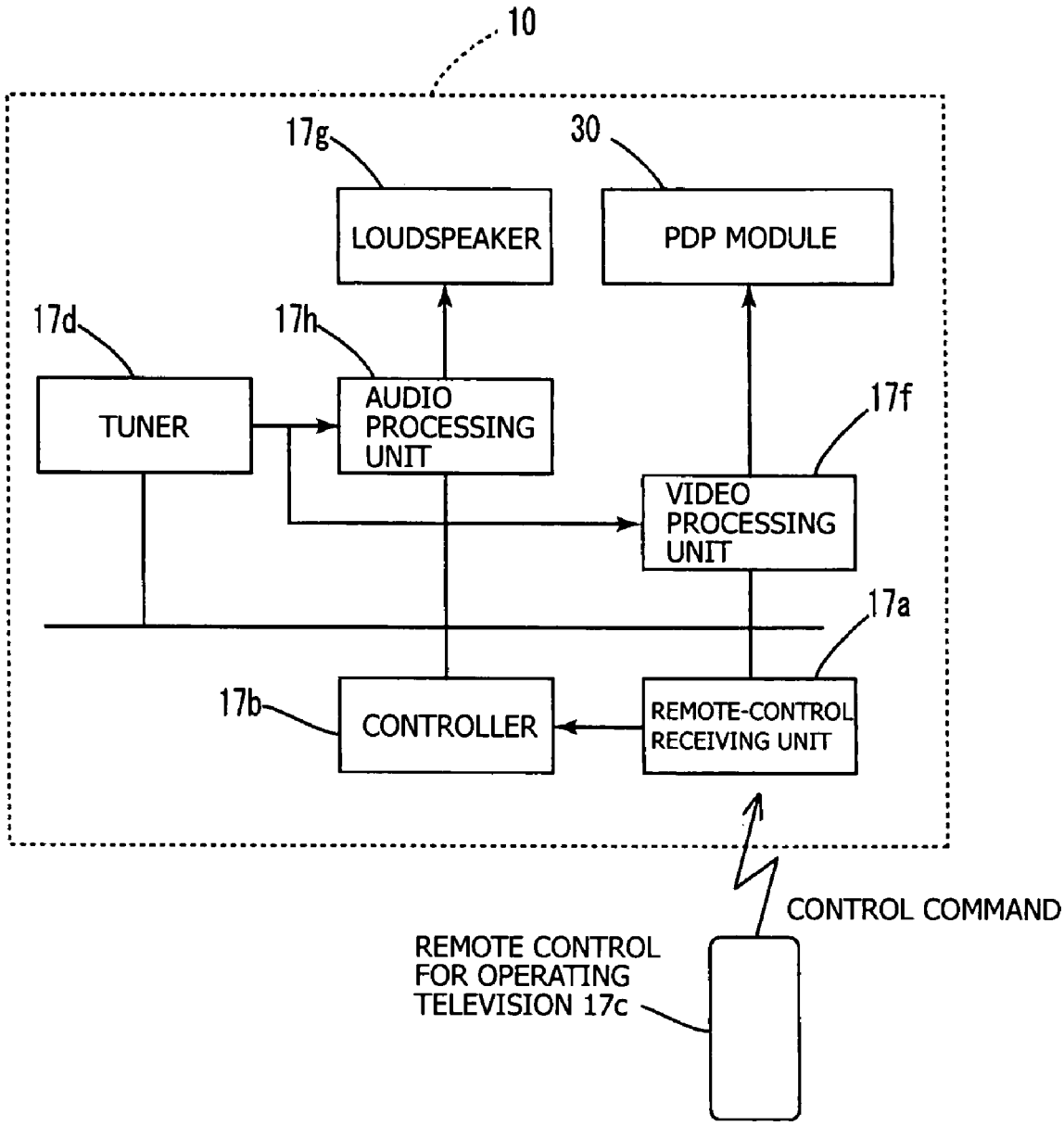
FIG. 1 is an exemplary illustration of a block diagram for use in explaining the outline configuration of a plasma television.

The detailed description set forth below in connection with the appended drawings is intended as description of presently preferred embodiments of the invention and is not intended to represent the only forms in which the present invention may be constructed and or utilized.

Another aspect of the present invention provides a packing structure for a plasma television 10 comprising a main body that includes a display surface of a plasma display panel on which a picture is displayed, and a left stand 10*a* and a right stand 10*b* that each have a base portion elongated from front to back and a shaft portion extended vertically upward from the base portion, that substantially vertically hold the display surface of the main body, and that are detachable from the main body, the packing structure comprising:

a lower box 11*a* that is substantially parallelepiped shaped with a horizontal length and a length from front to back that are sufficiently larger than those of the main body, whose height is smaller than that of the main body, and whose upper side is left open;

a lower left cushioning member 12*a*, a lower right cushioning member 12*c*, and a lower middle cushioning member 12*b* that are respectively disposed at a left end of an inner bottom of the lower box, at a right end of the inner bottom of the lower box, and substantially in a horizontal center of the inner bottom of the lower box, that have dents that are engaged with the bottom of the main body, and that are substantially flush with the lower box;

an upper left cushioning member 14*a*, an upper right cushioning member 14*c*, and an upper middle cushioning member 14*b* that are respectively disposed at the left end of a top of the main body, at the right end of the top of the main body, and substantially in the horizontal center of the top of the main body, and that have dents that are engaged with the top of the main body; and an upper box 11*b* substantially parallelepiped shaped whose lower side is left open, wherein:

an internal-side size of an opening is substantially squared with an external-side size of the lower box; the upper box is put from above onto the lower box in which the lower left cushioning member, lower right cushioning member, and lower middle cushioning member, main body, left stand, right stand, upper left cushioning member, upper right cushioning member, and upper middle cushioning member are mounted, when the upper left cushioning member, upper middle cushioning member, and upper right cushioning member abut on the top of the upper box, a lower end of the upper box becomes substantially flush with the bottom of the lower box;

at the upper right corner of a rear part of the lower left cushioning member 12*a*, a first fitting dent 12*a*2 to be fitted to the left stand is formed with a cushioning material left intact on the side of the back of the lower box 11*a*, a width of the first fitting dent 12*a*2 from front to back is substantially aligned with the width of the left stand 10*a*, and a first hole 12*a*3 is formed at the lower end of a left part of the first fitting dent 12*a*2 so that the first hole 12*a*3 will extend toward the leftward depths;

at the upper left corner of the rear part of the lower middle cushioning member 12*b*, a second fitting dent 12*b*2 to be fitted to the left stand 10*a* is formed with the cushioning material left intact on the side of the back of the lower box 11*a*, and the width of the second fitting dent 12*b*2 from front to back is substantially aligned with the width of the left stand 10*a;* at the upper left corner of the rear part of the lower right cushioning member 12*c*, a third fitting dent 12*c*2 to be fitted to the right stand 10*b* is formed with the cushioning material left intact on the side of the back of the lower box 11*a*, the width of the third fitting dent 12*c*2 from front to back is substantially aligned with the width of the right stand 10*b*, and a second hole 12*c*3 is formed at the lower end of a right part of the third fitting dent 12*c*2 so that the second hole 12*c*3 will extend toward the rightward depths;

at the upper right corner of the rear part of the lower middle cushioning member 12*b*, a fourth fitting dent 12*b*3 to be fitted to the right stand 10*b* is formed with the cushioning material left intact on the side of the back of the lower box 11*a*, and the width of the fourth fitting dent 12*b*3 from front to back is substantially aligned with the width of the right stand;

the right stand 10*b* is locked in the lower box 11*a* by first inserting a rear end of the base portion of the right stand 10*b* into the first hole 12*a*3, with the base portion fitted into the first fitting dent 12*a*2 and the second fitting dent 12*b*2;

the left stand 10*a* is locked in the lower box 11*a* by second inserting the rear end of the base portion of the left stand 10*a* into the second hole 12*c*3, with the base portion fitted into the third fitting dent 12*c*2 and the fourth fitting dent 12*b*3;

a fifth fitting dent 14*a*2 which is fitted to the base portion of the left stand 10*a* and has a width that is substantially identical to the width of the base portion is formed in the top of the upper left cushioning member 14*a;* a sixth fitting dent 14*c*2 which is fitted to the base portion of the right stand 10*b* and has a width that is substantially identical to the width of the base portion is formed in the top of the upper right cushioning member 14*c;* the back of the upper left cushioning member 14*a* has a first jut 14*a*3, and the back of the upper right cushioning member 14*c* has a second jut 14*c*3;

a first slit 11*a*1 and a second slit 11*a*2 in a face of the lower box 11*a* extend substantially vertically downward from an opening-side end of the lower box 11*a* so that a space between the first slit 11*a*1 and the second slit 11*a*2 will be aligned with the space between the left stand 10*a* and right stand 10*b* attached to the main body; and the first jut 14*a*3 and the second jut 14*c*3 are fitted into the first slit 11*a*1 and the second slit 11*a*2 respectively, the base portion of the left stand 10*a* and the base portion of the right stand 10*b* are fitted into the fifth fitting dent 14*a*2 and the sixth fitting dent 14*c*2 respectively, the shaft portions are inserted into stand insertion holes located the bottom of the main body, and the left stand 10*a* and the right stand 10*b* are screwed to the main body.

An embodiment of the present invention will be described according to the following sequence:

(1) Configuration of a plasma television (2) Plasma television packing structure (3) Assembling at the time of unpacking the plasma television (1) Configuration of a Plasma Television FIG. 1 is a block diagram for use in explaining the outline configuration of a plasma television 10 that is a panel display device. In the drawing, the plasma television 10 includes: a controller 17*b* that controls the action of a main body; a tuner 17*d* that samples a television signal on a selected channel from among television signals received via an antenna that is not shown, and transmits the sampled television signal; a video processing unit 17*f* that transmits a video signal based on the television signal sent from the tuner 17*d*; a plasma display panel (PDP) 30 serving as a display unit that displays a picture based on the video signal on a display surface; an audio processing unit 17*h* that transmits sounds based on the television signal sent from the tuner 17*d* through a loudspeaker 17*g*; and a remote-control receiving unit 17*a* that receives a control command sent from a remote control 17*c*.

The controller 17*b*, tuner 17*d*, video processing unit 17*f*, audio processing unit 17*h*, and remote-control receiving unit 17*a* are mounted as circuits on a motherboard and attached to the back of the PDP 30. The controller 17*b* controls turning on or off of a power supply, switching of channels, or increasing or decreasing of a volume in response to a control command received by the remote-control receiving unit 17*a*. Operational power is supplied from a power circuit, which is not shown, to the units included in the plasma television 10. The input voltage of the power circuit is a mains voltage (for example, AC 100 V).

The present embodiment will be described by taking for instance a plasma television that provides a picture using the PDP 30. As the panel display device relevant to the present invention, a liquid crystal television that provides a picture using a liquid crystal panel is also conceivable.

Figure 2:
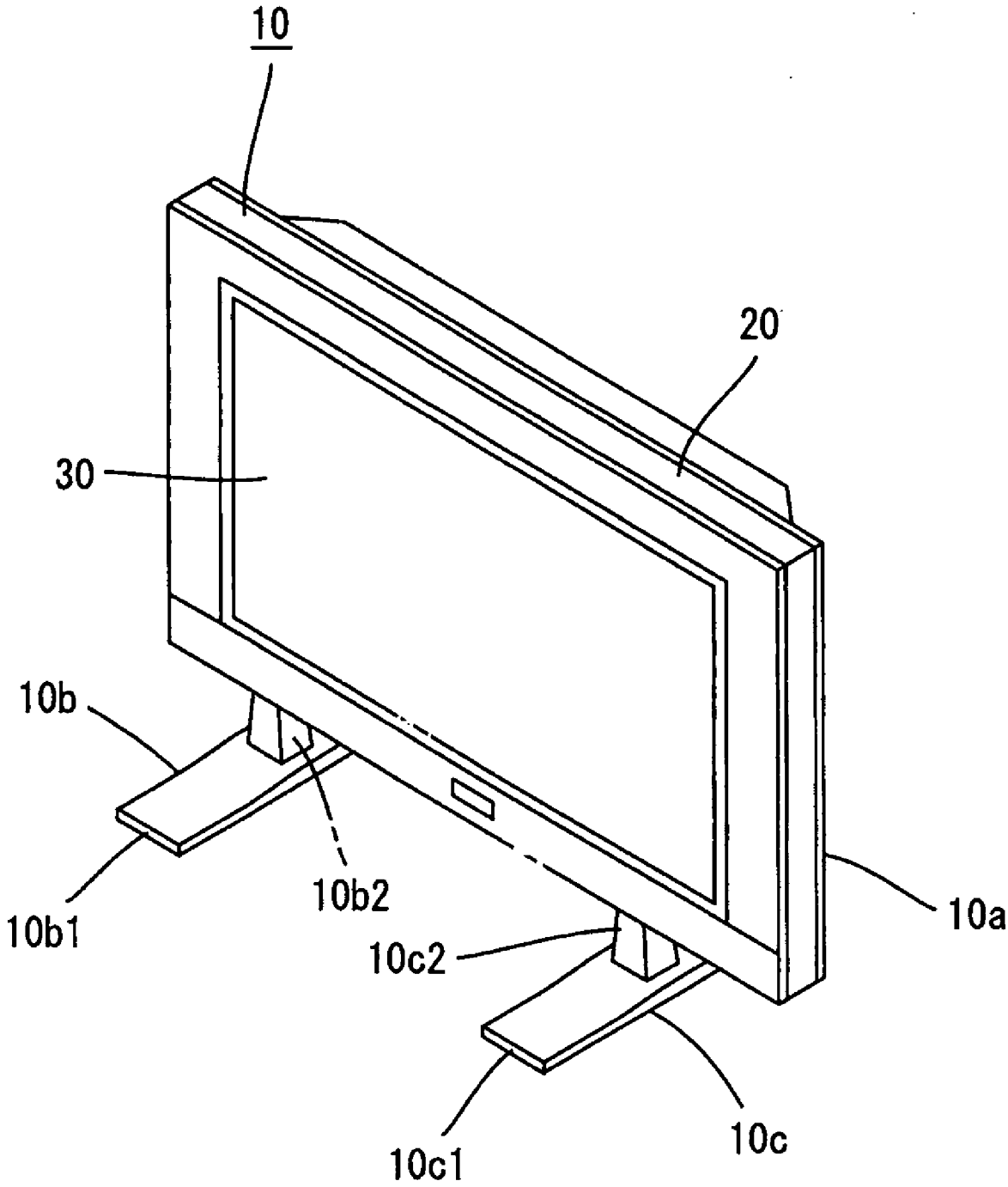
FIG. 2 is an exemplary illustration of a perspective view in which the plasma television is seen from obliquely forward.

FIG. 2 is a perspective view in which the plasma television 10 is seen from obliquely forward. In the drawing, a cabinet 20 serves as a housing that is shaped like a laterally elongated parallelepiped and is thin from front to back. The cabinet 20 includes a front cabinet that has a substantially rectangular opening, through which the display surface of the PDP 30 is bared, formed in the face thereof, and a rear cabinet that is united with the front cabinet from behind.

Further, a right stand 10*c* and a left stand 10*b* that substantially vertically hold the display surface of the plasma television 10 are jutted downward through insertion holes formed in the bottom of the cabinet 20. The right stand 10*c* and left stand 10*b* include a base portion 10*c*1 or 10*b*1 that comes into planar contact with the floor, and a right shaft portion 10*c*2 or a left shaft portion 10*b*2 that is extended substantially vertically upward from the associated base portion and formed with a bracket-shaped pipe. The base portions are elongated from front to back and designed so that the parts thereof extending forward from the shaft portions will be longer. The right stand 10*c* and left stand 10*b* are secured with screws, and become detachable from a main body 10*a* of the plasma television 10 by removing the screws.

(2) Plasma Television Packing Structure

Figure 3:
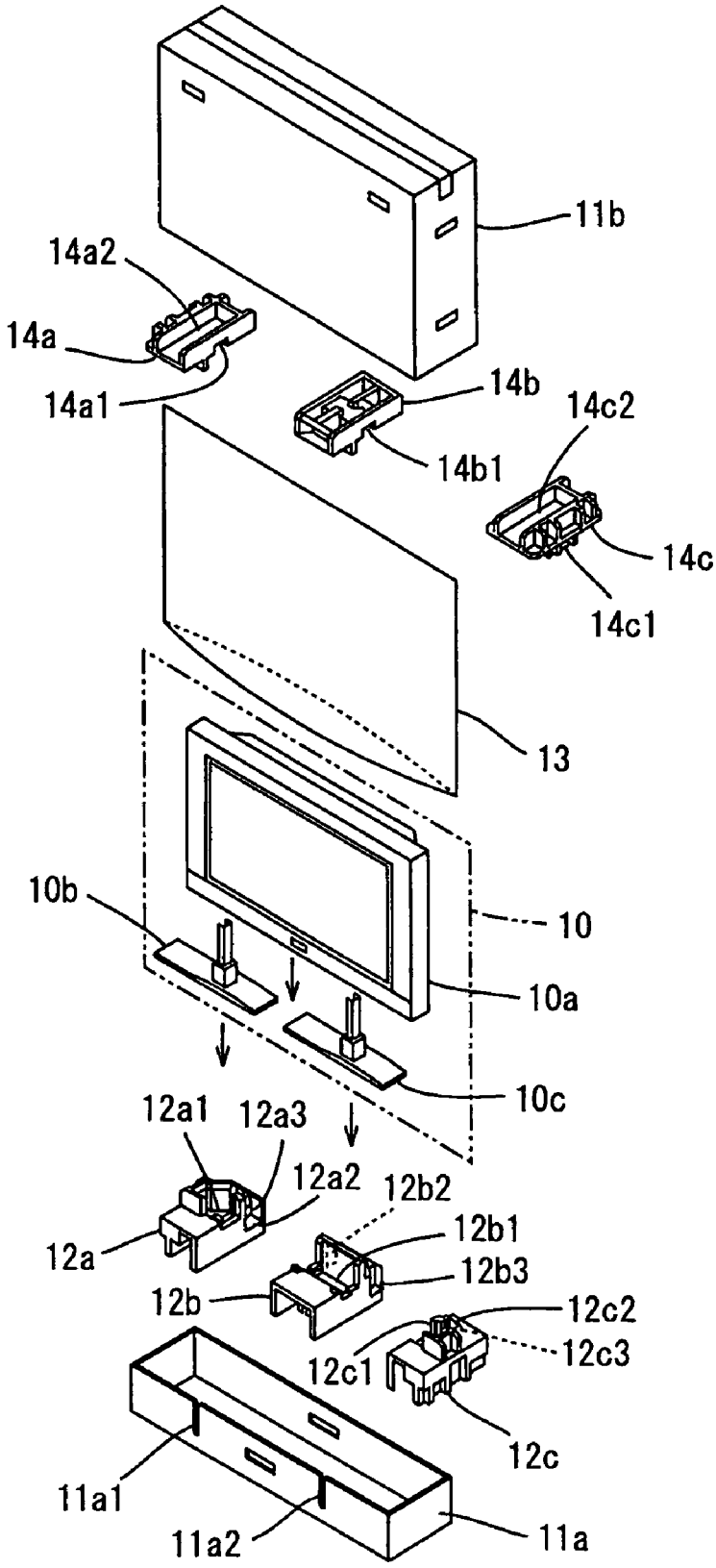
FIG. 3 is an exemplary illustration of a perspective view showing a plasma television packing structure in an exploded manner.
Figure 4:
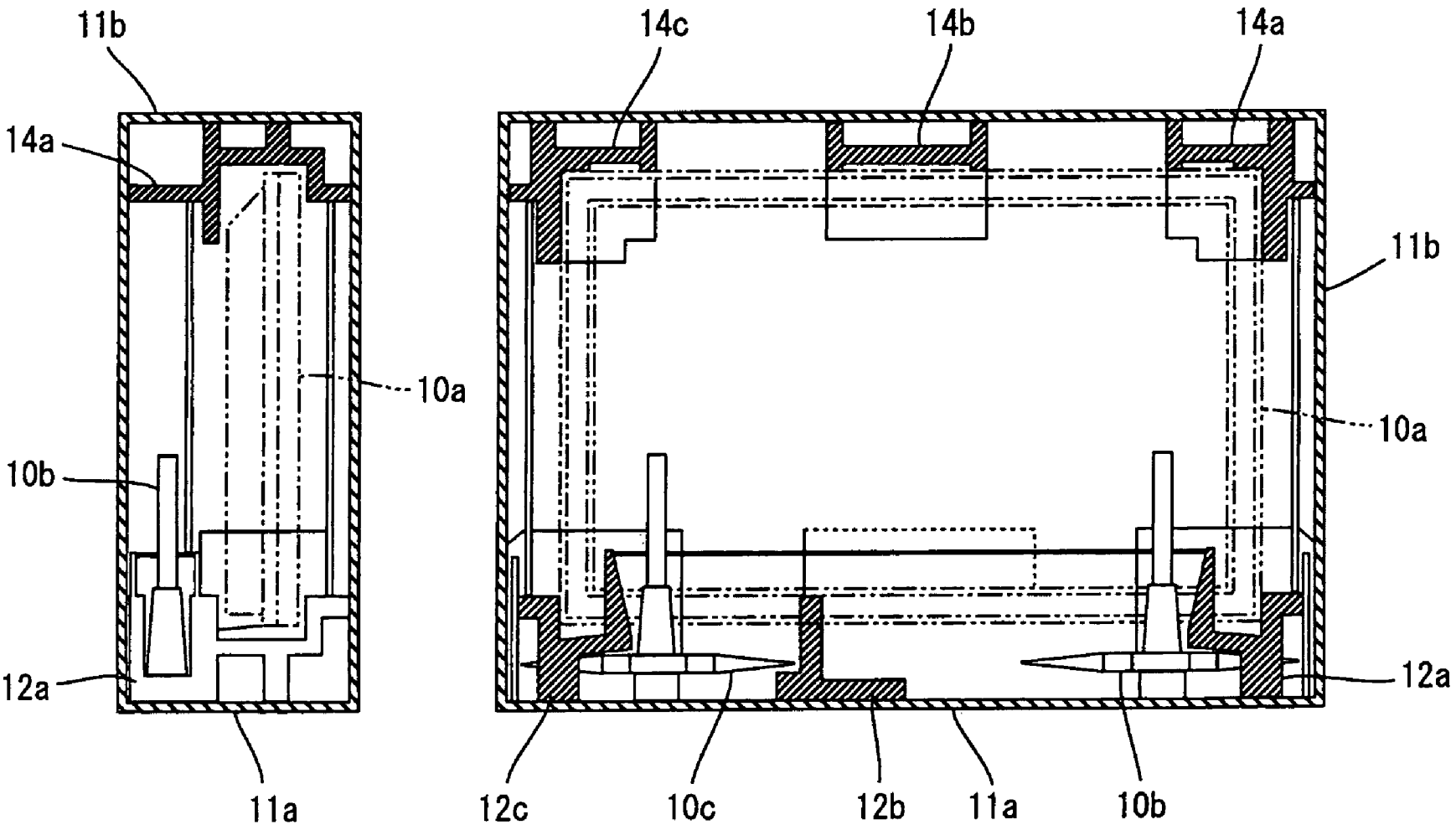
FIG. 4 is an exemplary illustration of a sectional view of the packing structure, with which the plasma television is packed, along a plane defined with vertical and horizontal directions, and a sectional view thereof along a plane defined with the vertical direction and the direction from front to back.
Figure 5:
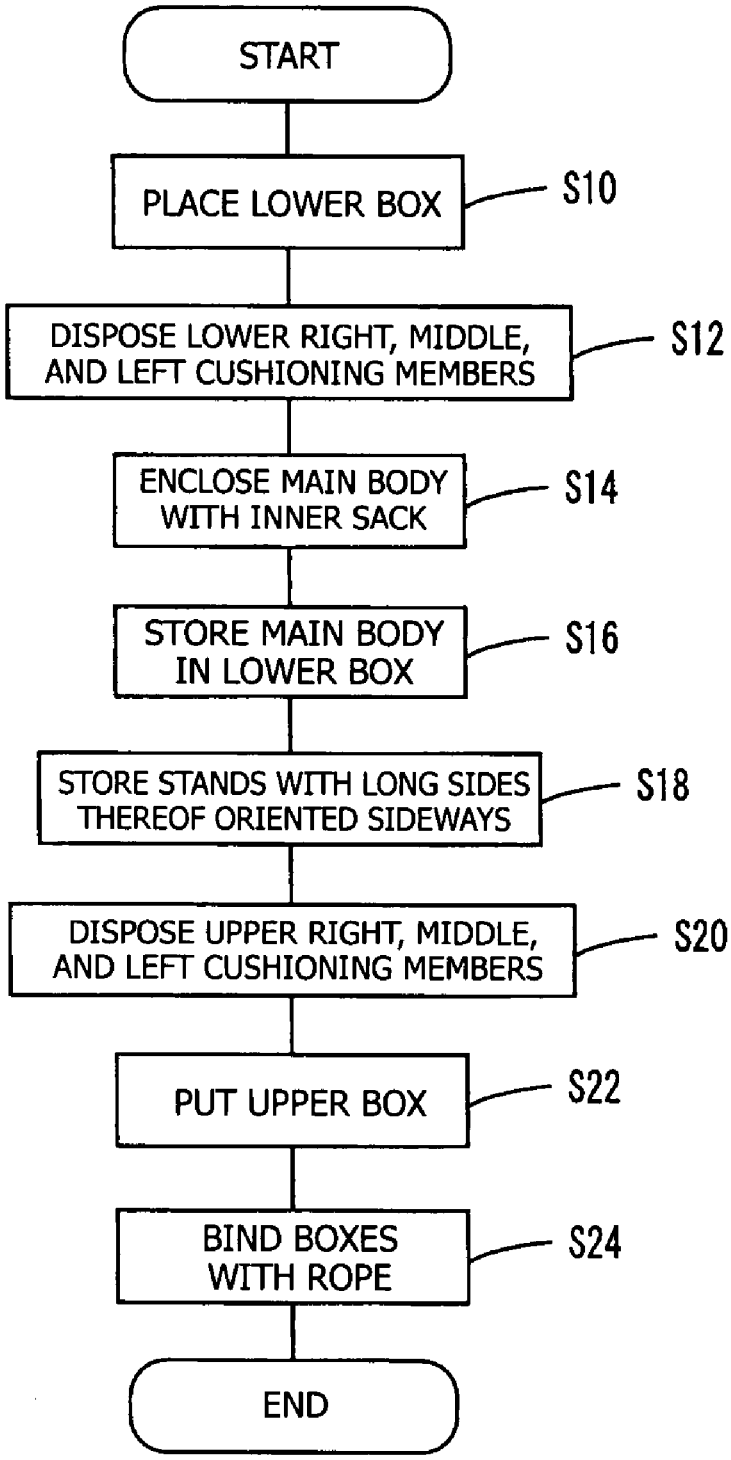
FIG. 5 is an exemplary illustration of a flowchart describing the work of packing the plasma television.

Referring to FIG. 3 to FIG. 5, a packing structure for the plasma television 10 and a packing sequence will be described below. FIG. 3 is a perspective view showing the plasma television packing structure in an exploded manner. FIG. 4 includes a sectional view of the packing structure, with which the plasma television is packed, along a plane defined with vertical and horizontal directions, and a sectional view thereof along a plane defined with the vertical direction and the direction from front to back. Hereinafter, the vertical and horizontal directions, and the direction from front to back will be described with the main body 10*a* as a reference.

In FIG. 3, a package 11 includes a lower box 11*a* and an upper box 11*b*. Moreover, a lower left cushioning member 12*a*, a lower right cushioning member 12*c*, a lower middle cushioning member 12*b*, the main body 10*a*, the left stand 10*b*, the right stand 10*c*, an inner sack 13, an upper left cushioning member 14*a*, an upper right cushioning member 14*c*, and an upper middle cushioning member 14*b* are stowed in the package 11.

The lower box 11*a* is made of cardboard, and the height of the lower box is almost the same as the respective heights of the cushioning members 12*a* to 12*c*. The horizontal length of the lower box and the length from front to back thereof are sufficiently larger than those of the main body 10*a*. The upper side of the substantially parallelepiped shape is left open. The lower left cushioning member 12*a*, lower right cushioning member 12*c*, and lower middle cushioning member 12*b* are disposed at the left end of the inside of the lower box 11*a*, at the right end thereof, and substantially in the horizontal center thereof respectively. At this time, the heights of the cushioning members 12*a* to 12*c* and the height of the lower box 11*a* are substantially squared with one another. When the main body 10*a* is mounted in the lower box 11*a* or when the main body 10*a* is taken out of the lower box 11*a*, a height by which the main body 10*a* has to be lifted may be small. This simplifies packing work and unpacking work alike and leads to improvement in workability and improvement in user-friendliness.

The upper box 11*b* is made of cardboard and shaped substantially like a parallelepiped whose lower side is left open. The size of the opening of the upper box 11*b* is determined so that the internal-side size thereof will be squared with the external-side size of the lower box 11*a*. Moreover, after the lower left cushioning member 12*a*, lower right cushioning member 12*c*, lower middle cushioning member 12*b*, main body 10*a*, left stand 10*b*, right stand 10*c*, inner sack 13, upper left cushioning member 14*a*, upper right cushioning member 14*c*, and upper middle cushioning member 14*b* are mounted in the lower box 11*a*, assuming that the upper box 11*b* is put from above, when the upper left cushioning member 14*a*, upper middle cushioning member 14*b*, and upper right cushioning member 14*c* come into contact with the top of the upper box 11*b*, the lower end of the upper box 11*b* becomes substantially flush with the bottom of the lower box 11*a*.

The lower left cushioning member 12*a*, lower right cushioning member 12*c*, and lower middle cushioning member 12*b* are made of expanded polystyrene. A dent 12*a*1 is formed at the upper right corner of the lower left cushioning member 12*a* so that it will extend substantially from the center of the top of the lower left cushioning member 12*a* to the right flank thereof. The lower left corner of the main body 10*a* abuts on the dent 12*a*1. In other words, the lower left cushioning member 12*a* plays a role of a buffer for the lower left corner of the main body 10*a* against the inner bottom of the lower box 11*a*, the face and back thereof, and the right flank thereof. A dent 12*c*1 is formed at the upper left corner of the lower right cushioning member 12*c* so that it will extend substantially from the center of the top of the lower right cushioning member 12*c* to the left flank thereof. The lower right corner of the main body 10*a* abuts on the dent 12*c*1. Namely, the lower right cushioning member 12*c* plays a role of a buffer for the lower right corner of the main body 10*a* against the bottom of the lower box 11*a*, the face and back thereof, and the right flank thereof. A groove-like dent 12*b*1 extending from the left flank of the lower middle cushioning member 12*b* to the right flank thereof is formed in the top of the lower middle cushioning member 12*b* so that it will extend from the left flank of the lower middle cushioning member 12*b* to the right flank thereof. The bottom of the horizontally center part of the main body 10*a* abuts on the dent 12*b*1. In other words, the lower middle cushioning member 12*b* plays a role of a buffer for the bottom of the horizontally center part of the main body 10*a* against the bottom of the lower box 11*a* and the face and back of the lower box 11*a*.

A fitting dent 12*a*2 (first fitting dent) that is fitted to the left stand 10*b* is formed at the upper right corner of the rear part of the lower left cushioning member 12*a* with expanded polystyrene left intact on the side of the back of the lower box 11*a*. The width of the fitting dent 12*a*2 from front to back is substantially squared with that of the left stand 10*b*. At the lower end of the left part of the fitting dent 12*a*2, a hole 12*a*3 (first hole) is formed toward the leftward depths. Moreover, at the upper left corner of the rear part of the lower middle cushioning member 12*b*, a fitting dent 12*b*2 (second fitting dent) that is fitted to the left stand 10*b* is formed with expanded polystyrene left intact on the side of the back of the lower box 11*a*. The width of the fitting dent 12*b*2 from front to back is substantially squared with that of the left stand 10*b*. After the rear end of the base portion 10*b*1 of the left stand 10*b* is inserted into a hole 12*a*3 formed in the lower left cushioning member 12*a*, when the base portion 10*b*1 thereof is fitted into the fitting dents 12*a*2 and 12*b*2 formed in the lower left cushioning member 12*a* and lower middle cushioning member 12*b* respectively, the left stand 10*b* is locked in the lower box 11*a*.

At the upper left corner of the rear part of the lower right cushioning member 12*c*, a fitting dent 12*c*2 (third fitting dent) that is fitted to the right stand 10*c* is formed with expanded polystyrene left intact on the side of the back of the lower box 11*a*. The width of the fitting dent 12*c*2 from front to back is substantially squared with the width of the right stand 10*c*. At the lower end of the right part of the fitting dent 12*c*2, a hole 12*c*3 (second hole) is formed toward the rightward depths. Moreover, at the upper right corner of the rear part of the lower middle cushioning member 12*b*, a fitting dent 12*b*3 (fourth fitting dent) that is fitted to the right stand 10*c* is formed with expanded polystyrene left intact on the side of the back of the lower box 11*a*. The width of the fitting dent 12*b*3 from front to back is substantially squared with the width of the right stand 10*c*. After the rear end of the base portion 10*c*1 of the right stand 10*c* is inserted into the hole 12*c*3 formed in the lower right cushioning member 12*c*, when the base portion 10*c*1 thereof is fitted into the fitting dents 12*c*2 and 12*b*3 formed in the lower right cushioning member 12*c* and lower middle cushioning member 12*b* respectively, the right stand 10*c* is locked in the lower box 11*a*.

As mentioned above, the hole 12*a*3 and fitting dent 12*a*2 in the lower left cushioning member 12*a*, the fitting dent 12*b*2 in the lower middle cushioning member 12*b*, and a space created between the lower left cushioning member 12*a* and lower middle cushioning member 12*b* constitute a base portion space for the left stand. The hole 12*c*3 and fitting dent 12*c*2 in the lower right cushioning member 12*c*, the fitting dent 12*b*3 in the lower middle cushioning member 12*b*, and a space between the lower left cushioning member 12*a* and lower middle cushioning member 12*b* constitute a base portion space for the right stand.

The upper left cushioning member 14*a*, upper right cushioning member 14*c*, and upper middle cushioning member 14*b* are made of expanded polystyrene. A dent 14*a*1 is formed at the lower right corner of the upper left cushioning member 14*a* so that it will extend substantially from the center of the bottom of the upper left cushioning member 14*a* to the right flank thereof. The upper left corner of the main body 10*a* abuts on the dent 14*a*1. In other words, the upper left cushioning member 14*a* plays a role of a buffer for the upper left corner of the main body 10*a* against the top, face, back, and left flank of the upper box 11*b*. A dent 14*c*1 is formed at the lower left corner of the upper right cushioning member 14*c* so that it will extend substantially from the center of the bottom of the upper right cushioning member 14*c* to the left flank thereof. The upper right corner of the main body 10*a* abuts on the dent 14*c*1. In other words, the upper right cushioning member 14*c* plays a role of a buffer for the upper right corner of the main body 10*a* against the top, face, back, and right flank of the upper box 11*b*. In the bottom of the upper middle cushioning member 14*b*, a groove-like dent 14*b*1 is formed to extend from the left flank thereof to the right flank thereof. The upper end of the horizontally center part of the main body 10*a* abuts on the dent 14*b*1. Namely, the upper middle cushioning member 14*b* plays a role of a buffer for the upper end of the horizontally center part of the main body 10*a* against the top, face, and back of the upper box 11*b*.

Referring to the flowchart of FIG. 5, how the plasma television 10 is packed using the foregoing structure will be described below.

For packing the plasma television 10, the lower box 11*a* is placed on a platform or a production line with the opening thereof oriented upward at step S10. At step S12, the lower left cushioning member 12*a*, lower middle cushioning member 12*b*, and lower right cushioning member 12*c* are disposed at the lower left corner of the lower box 11*a*, in the center thereof, and at the lower right corner thereof respectively. At step S14, the main body 10*a* is enclosed with the inner sack 13. At step S16, the main body 10*a* is placed in position while the bottom thereof is fitted into the dents 12*a*1, 12*b*1, and 12*c*1 formed in the lower left cushioning member 12*a*, lower middle cushioning member 12*b*, and lower right cushioning member 12*c* respectively.

At step S18, while the rear end of the base portion 10*b*1 of the left stand 10*b* is inserted into the hole 12*a*3, the base portion 10*b*1 of the left stand 10*b* is fitted into the fitting dent 12*a*2 and dent 12*b*2 alike. While the rear end of the base portion 10c1 of the right stand 10c is inserted into the hole 12c3, the base portion 10c1 of the right stand 10c is fitted into the fitting dent 12c2 and fitting dent 12b3 alike. Consequently, the left stand 10b and right stand 10c are placed in position with the long sides of the base portions 10b1 and 10c1 thereof oriented horizontally on the side of the back of the main body 10a and with the shaft portions 10b2 and 10c2 thereof oriented vertically.

At step S20, the dent 14a1, dent 14b1, and dent 14c1 are fitted to the upper left end of the main body 10a, the upper end of the center part thereof, and the upper right end thereof respectively. Thus, the upper left cushioning member 14a, upper middle cushioning member 14b, and upper right cushioning member 14c are placed in position.

At step S22, the upper box 11b is put over the lower box 11a so that the lower end of the upper box 11b will be flush with the lower end of the lower box 11a. The upper box 11b and lower box 11a are then united with each other. Finally, at step S24, the upper box 11b and lower box 11a are externally bound with a rope or packing tape for shipping.

(3) Assembling at the Time of Unpacking the Plasma Television

Figure 6:
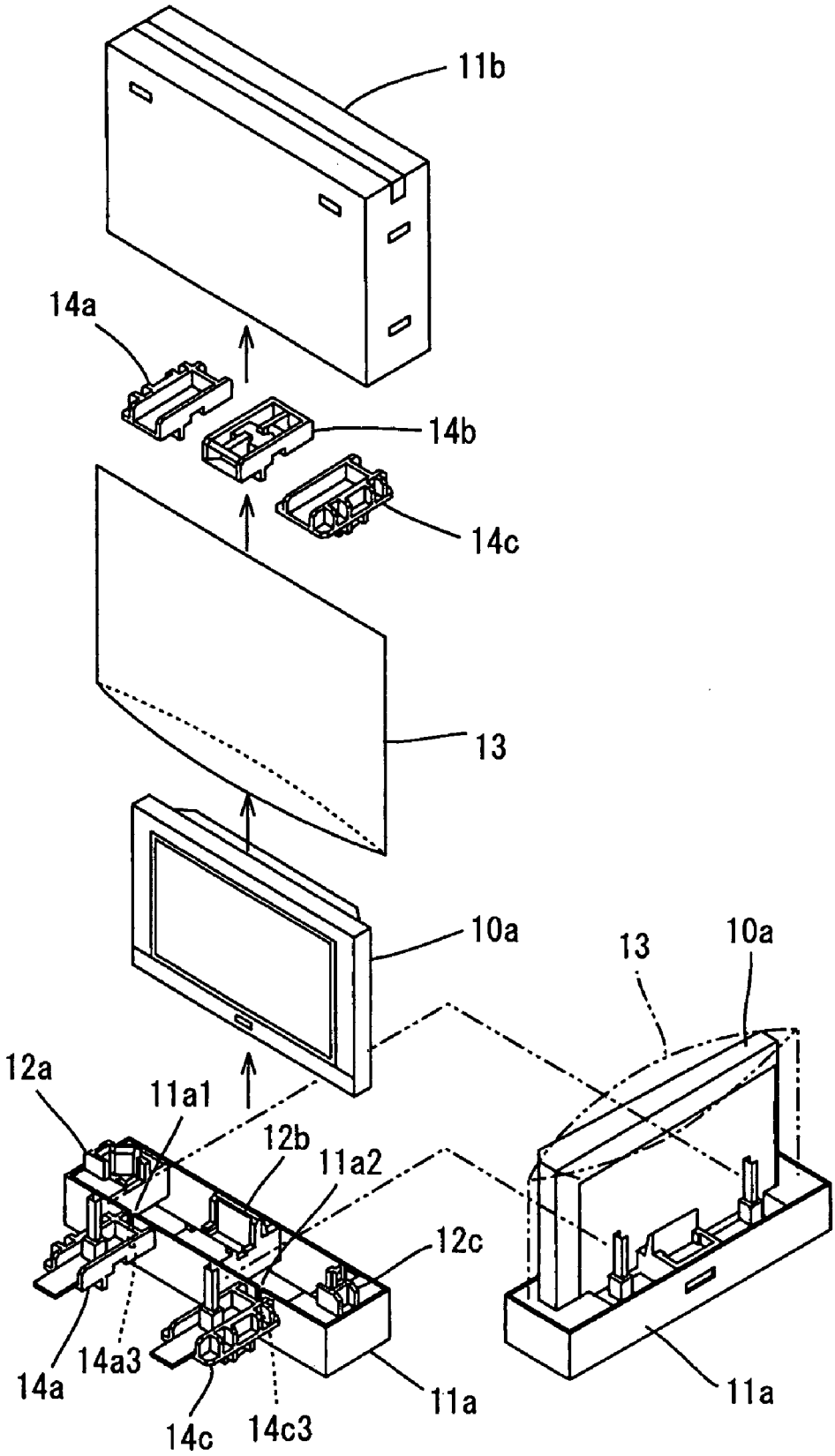
FIG. 6 is an exemplary illustration of a perspective view showing the packed plasma television in an exploded manner.
Figure 7:
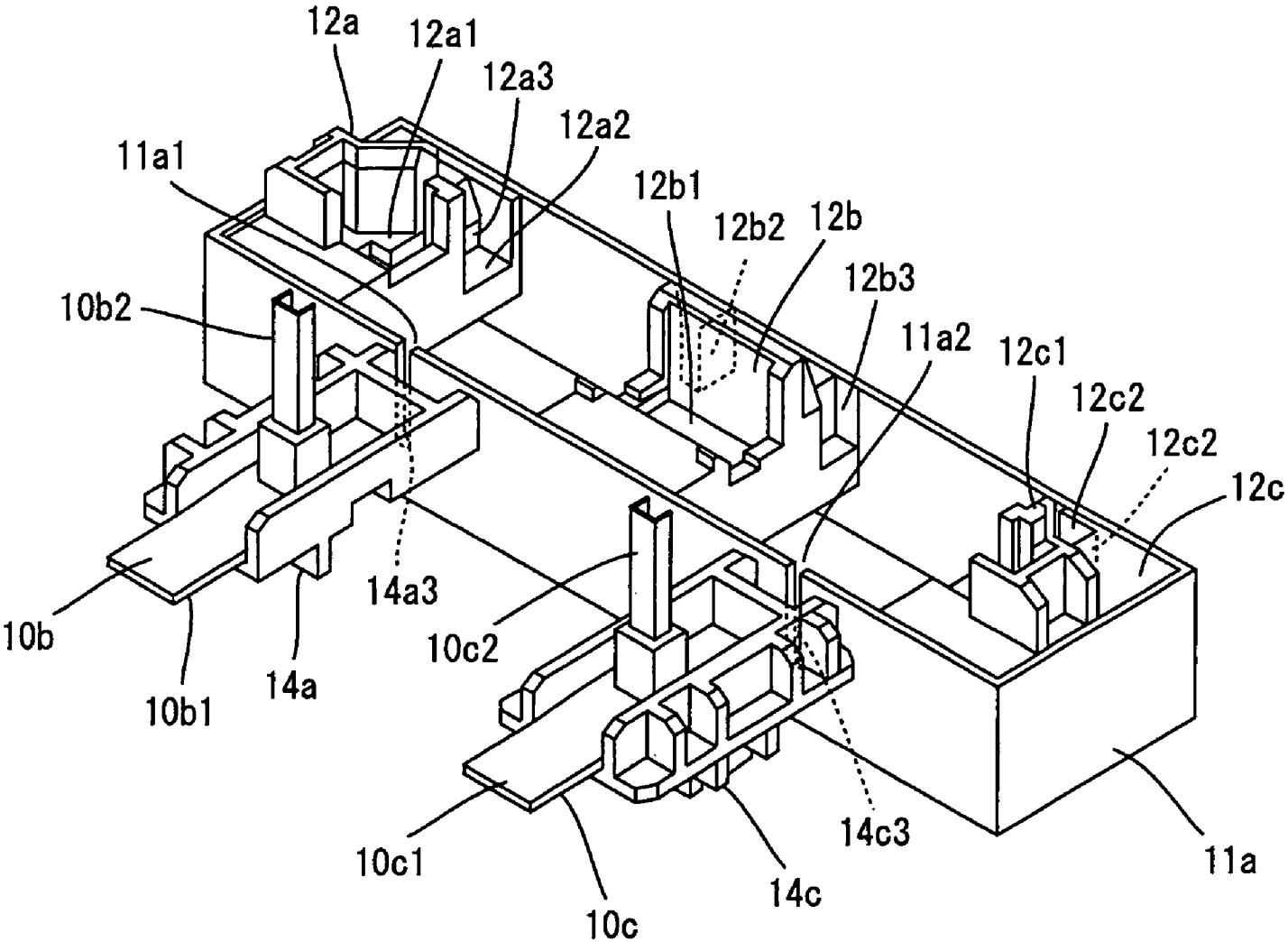
FIG. 7 is an exemplary illustration of a perspective view for use in explaining a stand attachment structure for the plasma television.
Figure 8:
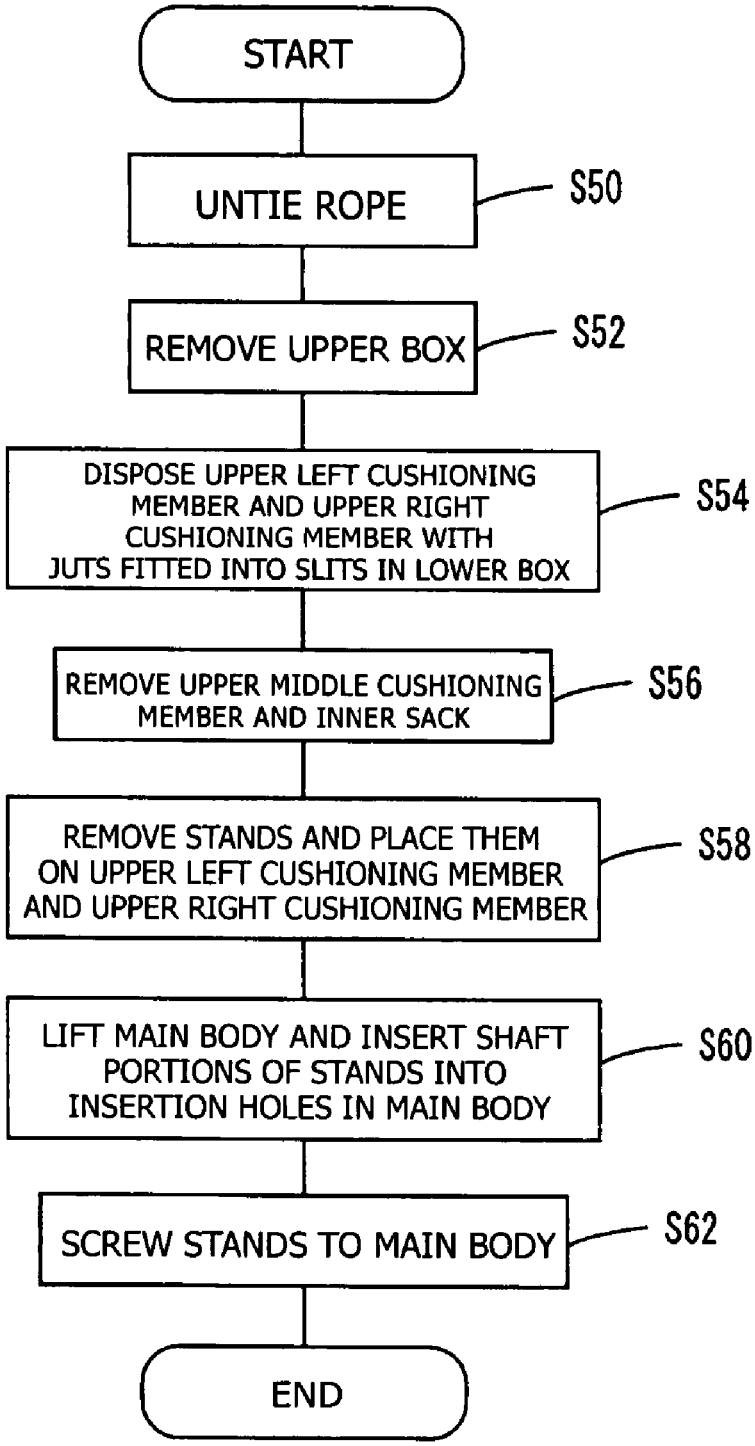
FIG. 8 is an exemplary illustration of a flowchart describing the flow of work of unpacking the package of the plasma television and assembling stands and a main body.
Figure 9:
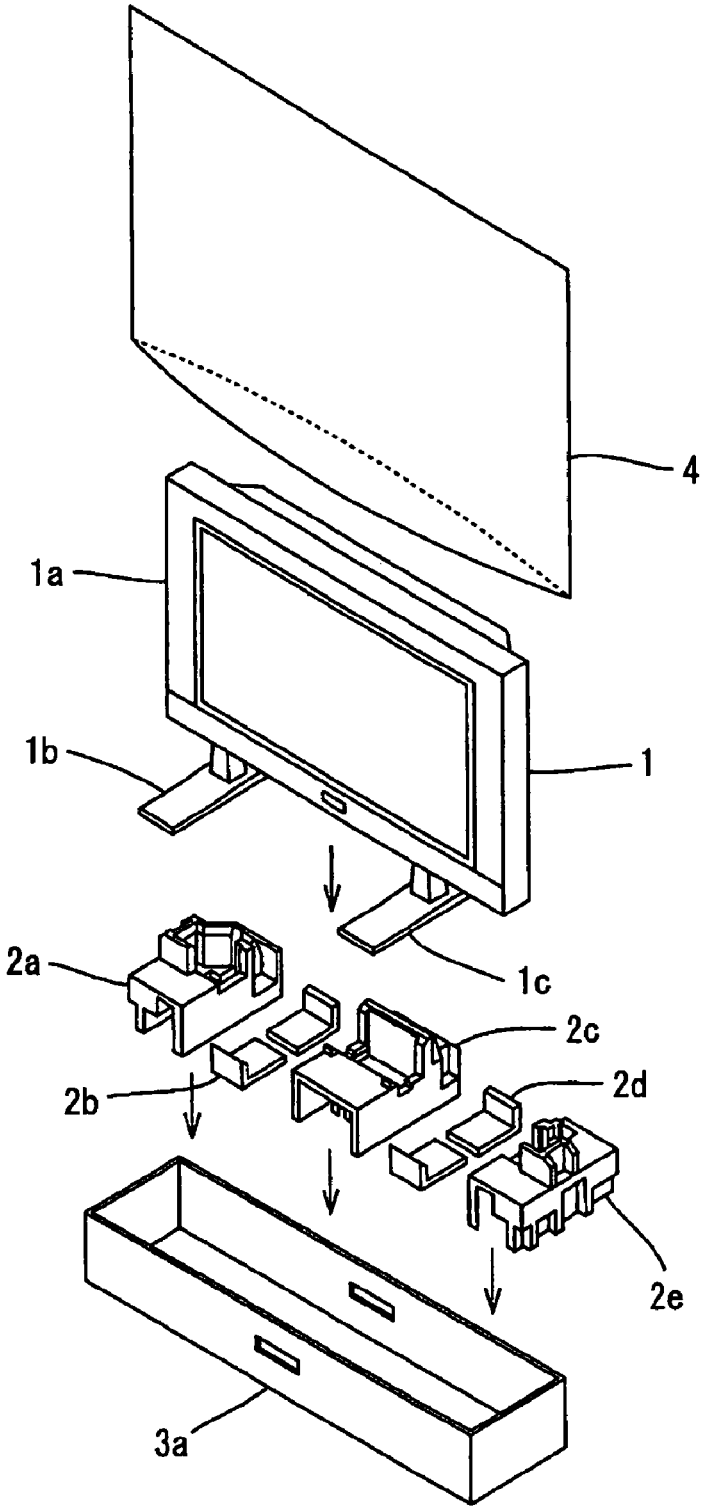
FIG. 9 is an exemplary illustration of a perspective view showing a conventional sequence that ends with mounting of a main body in a lower box.
Figure 10:
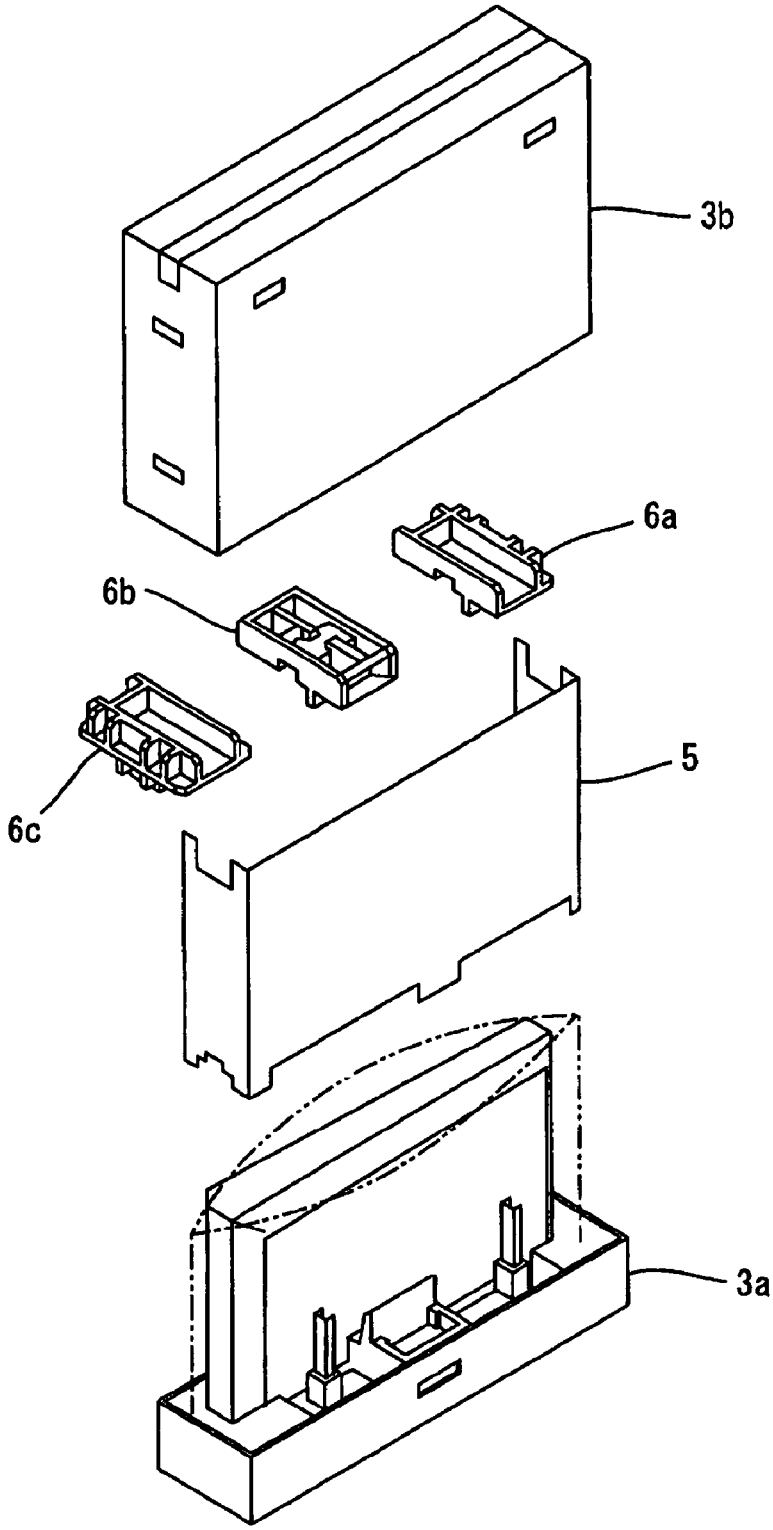
FIG. 10 is an exemplary illustration of a perspective view showing a scene where an upper box is united with the conventional lower box in which the main body is mounted.

According to the present invention, since the plasma television is packed with the left stand 10b and right stand 10c detached therefrom, the left stand 10b, right stand 10c, and main body 10a have to be assembled at the time of unpacking. However, the main body 10a of the plasma television or the region thereof including a display is large and heavyweight, the assembling work is hard to do. Consequently, the present invention includes a structure helping perform the assembling work. Referring to FIG. 6 to FIG. 8, the structure will be described and the assembling work utilizing the structure will be described. FIG. 6 is a perspective view showing the packed state of the plasma television in an exploded manner. FIG. 7 is a perspective view for use in explaining a stand attachment structure for the plasma television. FIG. 8 is a flowchart describing the flow of the work of unpacking the package of the plasma television and assembling the stands and main body.

A dent 14a2 (fifth fitting dent) that is fitted to the base portion 10b1 of the left stand 10b is formed on the top of the upper left cushioning member 14a. The width of the dent 14a2 is substantially identical to the width of the base portion 10b1. The upper left cushioning member 14a has no wall in front of the dent 14a2. When the base portion 10b1 is fitted into the dent 14a2, the front end of the base portion 10b1 comes out of the dent 14a2. As long as the length of the upper left cushioning member 14a from front to back is sufficiently large, the dent 14a2 may be formed in such a manner that the base portion 10b1 will not come out thereof.

Likewise, a dent 14c2 (sixth fitting dent) that is fitted to the base portion 10c1 of the right stand 10c is formed in the top of the upper right cushioning member 14c. The width of the dent 14c2 is substantially identical to the width of the base portion 10c1. The upper right cushioning member 14c has no wall in front of the dent 14c2. When the base portion 10c1 is fitted into the dent 14c2, the front end of the base portion 10c1 comes out of the dent 14c2. As long as the length of the upper right cushioning member 14c is sufficiently large, the dent 14c2 may be formed in such a manner that the base portion 10c1 will not come out thereof.

Moreover, a jut 14a3 (first jut) is formed on the back of the upper left cushioning member 14a, and a jut 14c3 (second jut) is formed on the back of the upper right cushioning member 14c. In the face of the lower box 11a, a slit 11a1 (first slit) and a slit 11a2 (second slit) are formed to extend substantially vertically downward from the opening-side end of the lower box.

The slit 11a1 and slit 11a2 are formed in the face of the lower box 11a so that the space between them will be squared with the space between holes in the main body 10a into which the left stand 10b and right stand 10c are inserted. Namely, in the face of the lower box 11a, the slit 11a1 and slit 11a2 are horizontally formed at offset positions with a predetermined space between them.

Moreover, the juts 14a3 and 14c3 are formed so that when the base portions 10b1 and 10c1 are fitted into the respective dents 14a2 and 14c2 in the upper left cushioning member and upper right cushioning members, they will come outside the respective rear ends of the base portions 10b1 and 10c1. The juts 14a3 and 14c3 are formed to have a size permitting the juts 14a3 and 14c3 to be engaged with the slits 11a1 and 11a2 respectively. When the juts 14a3 and 14c3 are engaged with the slits 11a1 and 11a2 respectively, the base portions 10b1 and 10c1 fitted into the dents 14a2 and 14c2 respectively become perpendicular to the face of the lower box 11a. Namely, the left shaft 10b2 and right shaft 10c2 are oriented substantially vertically upward with respect to the floor on which the base 11a is placed.

Referring to FIG. 8, the flow of the work of unpacking the package of the plasma television 10 and assembling the stands and main body using the foregoing structure will be described below.

When a user receives a packed plasma television, the user first unties the rope, with which the package 11 is bound, at step S50. At step S52, the upper box 11b is pulled upward and thus removed. Thereafter, at step S54, the upper left cushioning member 14a and upper right cushioning member 14c fitted to the upper left end of the main body 10a and the upper right end thereof are removed at step S54, and then placed in position with the respective juts 14a3 and 14c3 thereof fitted into the slits 11a1 and 11a2 respectively in the lower box 11a.

At step S56, the inner sack 13 is removed from the main body 10a. At step S58, the left stand 10b and right stand 10c are removed from the base portion space, and fitted into the dent 14a2 of the upper left cushioning member 14a and the dent 14c2 of the upper right cushioning member 14c respectively.

At step S60, the main body 10a is lifted. The left shaft portion 10b2 and right shaft portion 10c2 are aligned with the stand insertion holes in the bottom of the main body 10a, and the main body 10a is gradually lowered. Consequently, the left shaft portion 10b2 and right shaft portion 10c2 are inserted into the associated stand insertion holes. Finally, at step S62, the left stand 10b and right stand 10c are firmly screwed to the main body 10a.

While the long sides of the base portions 10b1 and 10c1 of the left stand 10b and right stand 10c respectively are oriented horizontally on the side of the back of the main body 10a and the shaft portions 10b2 and 10c2 thereof are oriented vertically, the left stand 10b and right stand 10c are mounted in the lower box 11a. Moreover, the jut 14a3 is fitted into the slit 11a1, and the jut 14c3 is fitted into the slit 11c1. The left stand 10b and right stand 10c are fitted into the dents 14a2 and 14c2 respectively. The insertion holes formed in the bottom of the main body 10 are aligned with the respective shaft portions 10b2 and 10c2 of the stands, and the shaft portions 10b2 and 10c2 are inserted into the respective insertion holes. Thus, while the attachment of packed stands is simplified, the volume of the package is reduced and the number of packages to be loaded in a freight container is increased.

As mentioned above, according to the present invention, there is provided a panel television packing structure in which base portions elongated from front to back are oriented horizontally, which permits a reduction in the volume of a box from front to back, which also permits a reduction in the vertical volume of the box because the stands are detached, and which makes it possible to expect a 12% increase in the number of packages to be loaded in a freight container.

Moreover, there is provided a stand attachment structure helping attach the stands to the main body by utilizing the separated upper cushioning members. Consequently, a load a user incurs at the time of attaching the stands can be reduced.

Moreover, the number of cushioning members can be decreased, and a stand attachment structure helping attach the stands to the main body by utilizing the separated cushioning members can be provided. Consequently, a load a user incurs at the time of attaching the stands can be reduced.

Moreover, the panel display device can be easily taken out of the lower box.

A load a user incurs at the time of unpacking can be reduced.

Further, the number of cushioning members can be decreased, and the detached stands can be disposed among the cushioning members.

Further, needless to say, the same operations as those exerted by the aforesaid aspects of the invention can be exerted in more concrete structures.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

Another aspect of the present invention provides a packing structure for a panel display device comprising a main body that includes a panel display unit, and right and left stands that each have a base portion elongated form forth to back and a shaft portion extending vertically upward from the base portion, that substantially vertically hold the display surface of the main body, and that are detachable from the main body, the packing structure comprising:

a substantially parallelepiped box whose upper side can be left open and which is horizontally long and short from front to back;

a lower cushioning member that is disposed on the inner bottom of the box and has a dent which is engaged with the bottom of the main body;

a base portion space that is created in the lower cushioning member on the side of the back of the main body and receives the base portions of the right and left stands with the long sides of the base portions oriented horizontally; and an upper cushioning member that is disposed inside the top of the box and has a dent which is engaged with the top of the main body, wherein:

the stands are disposed in the base portion space with the shaft portions thereof extended along the back of the main body; and the box accommodates the lower cushioning member, main body, upper cushioning member, and stands.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

What is claimed is:

1. A packing structure for a panel display device comprising:

a panel display device comprising a main body that includes a panel display unit, and right and left stands that each have a base portion elongated from front to back and a shaft portion extending vertically upward from the base portion, which holds the main body, and that is detachable from the main body;

a box elongated horizontally with an upper side that can be left open;

a lower cushioning member disposed on an inner bottom of the box;

the lower cushioning member having a dent that is engaged with a bottom of the main body;

an upper cushioning member disposed inside a top of the box;

the upper cushioning member having a dent that is engaged with a top of the main body;

the box having a base portion space that is created in the lower cushioning member on a side of a back of the main body and receives the base portions oriented horizontally;

the right and left stands disposed in the base portion space with the shaft portions extended along the back of the main body;

the box accommodating the lower cushioning member, the main body, the upper cushioning member, and the right and left stands;

the base portions substantially vertically hold the display surface of the main body;

the box is substantially parallelepiped;

the upper cushioning member includes an upper right cushioning member to be disposed at a right end of the top of the main body, an upper left cushioning member to be disposed at a left end of the top of the main body, and an upper middle cushioning member to be disposed substantially in a horizontal center of the top of the main body;

the upper right cushioning member and upper left cushioning member each include a dent that is fitted to the base portion of the right or left stand, and a jut that is formed outside a region which abuts on a rear end of the base portion; and at a lower end of the box, slits to be fitted to the juts are formed at offset positions so that a width between the slits will be identical to the width between the shaft portions attached to the main body.

2. The packing structure according to claim 1, wherein the stands are attached to the main body by fitting the juts into the respective slits, fitting the base portions of the right and left stands into the respective dents, and then inserting the shaft portions into insertion holes formed in the bottom of the main body.

3. The packing structure according to claim 1, wherein a direction from front to back of the stands to be fitted into the respective dents is squared with the direction from front to back of the main body to be stored in the box.

4. The packing structure according to claim 1, wherein the box includes a lower box shaped substantially like a parallelepiped whose upper side is left open and which has the lower cushioning member disposed on the inner bottom of the lower box, and an upper box to be united with the lower box from above.

5. The packing structure according to claim 1, wherein a height of the lower box is substantially identical to a height of the lower cushioning member.

6. The packing structure according to claim 1, wherein:

the lower cushioning member includes a lower right cushioning member to be disposed at the right end of the inner bottom of the box, a lower left cushioning member to be disposed at the left end of the inner bottom of the box, and a lower middle cushioning member to be disposed substantially in a horizontal center of the inner bottom of the box; and the base portion space includes a space created between the lower left cushioning member and lower middle cushioning member, and a space created between the lower might cushioning member and lower middle cushioning member.

7. A packing structure for a panel display device comprising:

a panel display device comprising a main body that includes a panel display unit, and right and left stands that each include a base portion elongated from front to back and a shaft portion extended vertically upward from the base portion, which hold the main body, and that are detachable from the main body;

a box elongated horizontally with an upper side that can be left open;

a lower cushioning member disposed on an inner bottom of the box;

the lower cushioning member having a dent that is engaged with a bottom of the main body;

an upper cushioning member disposed inside a top of the box;

the upper cushioning member having a dent that is engaged with a top of the main body;

the box accommodating the lower cushioning member, the main body, the right and left stands, and the upper cushioning member;

the upper cushioning member including an upper right cushioning member to be disposed at a right end of the top of the main body;

the upper cushioning member including an upper left cushioning member to be disposed at a left end of the top of the main body;

the upper right cushioning member including a dent that is fitted to the base portion of the right stand;

the upper right cushioning member including a jut that is formed outside a region that abuts on a rear end of the base portion of the right stand;

the upper left cushioning member including a dent that is fitted to the base portion of the left stand;

the upper left cushioning member including a jut that is formed outside a region that abuts on a rear end of the base portion of the left stand;

slits fitted to the juts; and the slits formed at offset positions so that a width between the slits will be identical to a width between the shaft portions attached to the main body at a lower end of the box.

8. The packing structure according to claim 7, wherein:

the base portion substantially vertically holds a display surface of the main body; and the box is substantially parallelepiped;

the box is horizontally long and is short from front to back.

9. The packing structure according to claim 7, wherein the stands are attached to the main body by fitting the juts into the respective slits, fitting the base portions of the right and left stands into the respective dents, and then inserting the shaft portions into insertion holes formed in the bottom of the main body.

10. The packing structure according to claim 7, wherein a direction from front to back of the stands to be fitted into the respective dents is squared with the direction from front to back of the main body to be stored in the box.

11. The packing structure according to claim 7, wherein the box includes a lower box shaped substantially like a parallelepiped whose upper side is left open and which has the lower cushioning member disposed on the inner bottom of the lower box, and an upper box to be united with the lower box from above.

12. The packing structure according to claim 7, wherein a height of the lower box is substantially identical to a height of the lower cushioning member.

13. The packing structure according to claim 7, wherein:

the lower cushioning member includes a lower right cushioning member to be disposed at the right end of the inner bottom of the box, a lower left cushioning member to be disposed at the left end of the inner bottom of the box, and a lower middle cushioning member to be disposed substantially in a horizontal center of the inner bottom of the box.

14. A packing structure for a plasma television comprising:

a plasma television comprising a main body that includes a display surface of a plasma display panel on which a picture is displayed, and a left stand and a right stand that each have a base portion elongated from front to back and a shaft portion extended vertically upward from the base portion, that substantially vertically hold the display surface of the main body, and that are detachable from the main body;

a lower box that is substantially parallelepiped shaped with a horizontal length and a length from front to back that are sufficiently larger than those of the main body, whose height is smaller than that of the main body, and whose upper side is left open;

a lower left cushioning member, a lower right cushioning member, and a lower middle cushioning member that are respectively disposed at a left end of an inner bottom of the lower box, at a right end of the inner bottom of the lower box, and substantially in a horizontal center of the inner bottom of the lower box, that have dents that are engaged with the bottom of the main body, and that are substantially flush with the lower box;

an upper left cushioning member, an upper right cushioning member, and an upper middle cushioning member that are respectively disposed at the left end of a top of the main body, at the right end of the top of the main body, and substantially in the horizontal center of the top of the main body, and that have dents that are engaged with the top of the main body; and an upper box substantially parallelepiped shaped whose lower side is left open, wherein:

an internal-side size of an opening is substantially squared with an external-side size of the lower box; the upper box is put from above onto the lower box in which the lower left cushioning member, lower right cushioning member, and lower middle cushioning member, main body, left stand, right stand, upper left cushioning member, upper right cushioning member, and upper middle cushioning member are mounted, when the upper left cushioning member, upper middle cushioning member, and upper right cushioning member abut on the top of the upper box, a lower end of the upper box becomes substantially flush with the bottom of the lower box;

at the upper right corner of a rear part of the lower left cushioning member, a first fitting dent to be fitted to the left stand is formed with a cushioning material left intact on the side of the back of the lower box, a width of the first fitting dent from front to back is substantially aligned with the width of the left stand, and a first hole is formed at the lower end of a left part of the first fitting dent so that the first hole will extend toward the leftward depths;

at the upper left corner of the rear part of the lower middle cushioning member, a second fitting dent to be fitted to the left stand is formed with the cushioning material left intact on the side of the back of the lower box, and the width of the second fitting dent from front to back is substantially aligned with the width of the left stand;

at the upper left corner of the rear part of the lower right cushioning member, a third fitting dent to be fitted to the right stand is formed with the cushioning material left intact on the side of the back of the lower box, the width of the third fitting dent from front to back is substantially aligned with the width of the right stand, and a second hole is formed at the lower end of a right part of the third fitting dent so that the second hole will extend toward the rightward depths;

at the upper right corner of the rear part of the lower middle cushioning member, a fourth fitting dent to be fitted to the right stand is formed with the cushioning material left intact on the side of the back of the lower box, and the width of the fourth fitting dent from front to back is substantially aligned with the width of the right stand;

the right stand is locked in the lower box by first inserting a rear end of the base portion of the right stand into the first hole, with the base portion fitted into the first fitting dent and second fitting dent;

the left stand is locked in the lower box by second inserting the rear end of the base portion of the left stand into the second hole, with the base portion fitted into the third fitting dent and fourth fitting dent;

a fifth fitting dent that is fitted to the base portion of the left stand and has a width that is substantially identical to the width of the base portion is formed in the top of the upper left cushioning member;

a sixth fitting dent that is fitted to the base portion of the right stand and has a width that is substantially identical to the width of the base portion is formed in the top of the upper right cushioning member;

the back of the upper left cushioning member has a first jut, and the back of the upper right cushioning member has a second jut;

a first slit and a second slit in a face of the lower box extend substantially vertically downward from an opening-side end of the lower box so that a space between the first slit and second slit is aligned with the space between the left stand and right stand attached to the main body; and the first jut and second jut are fitted into the first slit and second slit respectively, the base portion of the left stand and the base portion of the right stand are fitted into the fifth fitting dent and sixth fitting dent respectively, the shaft portions are inserted into stand insertion holes located the bottom of the main body, and the left stand and right stand are screwed to the main body.

* * * * *